US009850897B2

(12) United States Patent
Twidale et al.

(10) Patent No.: US 9,850,897 B2
(45) Date of Patent: Dec. 26, 2017

(54) PROGRESSING CAVITY STATOR WITH GAS BREAKOUT PORT

(71) Applicant: Cameron International Corporation, Houston, TX (US)

(72) Inventors: Derek L. Twidale, Cypress, TX (US); Brennon Cote, Cypress, TX (US)

(73) Assignee: Cameron International Corporation, Houston, TX (US)

( * ) Notice: Subject to any disclaimer, the term of this patent is extended or adjusted under 35 U.S.C. 154(b) by 217 days.

(21) Appl. No.: 14/581,593

(22) Filed: Dec. 23, 2014

(65) Prior Publication Data

US 2015/0184654 A1 Jul. 2, 2015

Related U.S. Application Data

(60) Provisional application No. 61/921,895, filed on Dec. 30, 2013.

(51) Int. Cl.

| | |
|---|---|
| ***B23P 15/00*** | (2006.01) |
| ***F04C 13/00*** | (2006.01) |
| ***F04C 2/107*** | (2006.01) |

(52) U.S. Cl.

CPC ..... *F04C 13/008* (2013.01); *F04C 2/1075* (2013.01); *F04C 2220/40* (2013.01); *F04C 2240/70* (2013.01); *Y10T 29/49249* (2015.01)

(58) Field of Classification Search

CPC ..... F04C 13/008; F04C 2240/70; F04C 2220/40; F04C 2/1075

USPC ..... 418/48

See application file for complete search history.

(56) References Cited

U.S. PATENT DOCUMENTS

| | | | | |
|---|---|---|---|---|
| 3,912,426 | A | 10/1975 | Tschirky | |
| 5,832,604 | A * | 11/1998 | Johnson | E21B 4/02 29/447 |
| 6,336,796 | B1 * | 1/2002 | Cholet | F04C 2/1075 418/153 |
| 2007/0172371 | A1 | 7/2007 | Podmore | |
| 2010/0284842 | A1 | 11/2010 | Jager | |
| 2012/0282128 | A1 | 11/2012 | Lessmann et al. | |
| 2014/0134029 | A1 | 5/2014 | Coghlan, III et al. | |

FOREIGN PATENT DOCUMENTS

| | | |
|---|---|---|
| CA | 2364873 | 11/2005 |

* cited by examiner

*Primary Examiner* — Mark Laurenzi
*Assistant Examiner* — Anthony Ayala Delgado
(74) *Attorney, Agent, or Firm* — Eubanks PLLC

(57) ABSTRACT

Progressing cavity devices and systems are provided. In one embodiment, a stator of a progressing cavity device includes metal plates with apertures that are rotationally offset to form a winding rotor conduit for receiving a rotor of the progressing cavity device. A layer of elastomer can be provided on edges of the apertures of the metal plates in the winding rotor conduit, and the stator can also include a gas breakout port through the metal plates to enable gas between the metal plates to escape the stator. Additional systems, devices, and methods are also disclosed.

19 Claims, 7 Drawing Sheets

PROGRESSING CAVITY STATOR WITH GAS BREAKOUT PORT

BACKGROUND

This section is intended to introduce the reader to various aspects of art that may be related to various aspects of the presently described embodiments. This discussion is believed to be helpful in providing the reader with background information to facilitate a better understanding of the various aspects of the present embodiments. Accordingly, it should be understood that these statements are to be read in this light, and not as admissions of prior art.

In order to meet consumer and industrial demand for natural resources, companies often invest significant amounts of time and money in finding and extracting oil, natural gas, and other subterranean resources from the earth. Particularly, once a desired subterranean resource such as oil or natural gas is discovered, drilling and production systems are often employed to access and extract the resource. These systems may be located onshore or offshore depending on the location of a desired resource. Further, such systems generally include a wellhead assembly mounted on a well through which the resource is accessed or extracted. These wellhead assemblies can include a wide variety of components, such as various casings, valves, pumps, fluid conduits, and the like, that control drilling or extraction operations.

In some instances, resources accessed via wells are able to flow to the surface by themselves. This is typically the case with gas wells, as the accessed gas has a lower density than air. This can also be the case for oil wells if the pressure of the oil is sufficiently high to overcome gravity. But often the oil does not have sufficient pressure to flow to the surface and it must be lifted to the surface through one of various methods known as artificial lift. Artificial lift can also be used to raise other resources through wells to the surface, or for removing water or other liquids from gas wells. Some forms of artificial lift use a pump that is placed downhole in the well, such as a progressing cavity pump having a stator that cooperates with a helical rotor to draw fluid up the well.

SUMMARY

Certain aspects of some embodiments disclosed herein are set forth below. It should be understood that these aspects are presented merely to provide the reader with a brief summary of certain forms the invention might take and that these aspects are not intended to limit the scope of the invention. Indeed, the invention may encompass a variety of aspects that may not be set forth below.

Embodiments of the present disclosure generally relate to progressing cavity devices, such as progressing cavity pumps. More specifically, in one embodiment a progressing cavity device includes a stator formed with a series of plates having apertures that define a rotor conduit of the device. The rotor conduit can be lined with a coating, such as a layer of elastomer provided over the edges of the plate apertures forming the rotor conduit. Left unchecked, gas trapped inside the stator (e.g., between the plates) could damage the coating and negatively impact the operation of the progressing cavity device. Accordingly, the stator includes a gas breakout port that allows gas between the plates to exit the stator.

Various refinements of the features noted above may exist in relation to various aspects of the present embodiments. Further features may also be incorporated in these various aspects as well. These refinements and additional features may exist individually or in any combination. For instance, various features discussed below in relation to one or more of the illustrated embodiments may be incorporated into any of the above-described aspects of the present disclosure alone or in any combination. Again, the brief summary presented above is intended only to familiarize the reader with certain aspects and contexts of some embodiments without limitation to the claimed subject matter.

BRIEF DESCRIPTION OF THE DRAWINGS

These and other features, aspects, and advantages of certain embodiments will become better understood when the following detailed description is read with reference to the accompanying drawings in which like characters represent like parts throughout the drawings, wherein.

DETAILED DESCRIPTION OF SPECIFIC EMBODIMENTS

Specific embodiments of the present disclosure are described below. In an effort to provide a concise description of these embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

When introducing elements of various embodiments, the articles "a," "an," "the," and "said" are intended to mean that there are one or more of the elements. The terms "comprising," "including," and "having" are intended to be inclusive and mean that there may be additional elements other than the listed elements. Moreover, any use of "top," "bottom," "above," "below," other directional terms, and variations of these terms is made for convenience, but does not require any particular orientation of the components.

Figure 1:
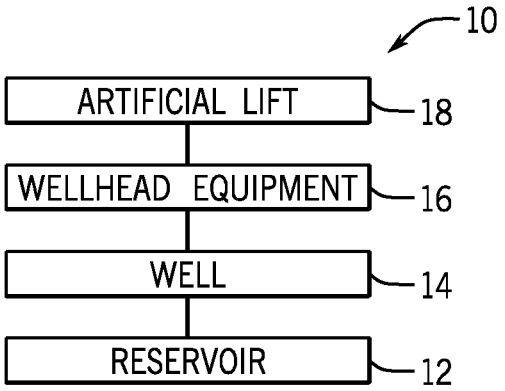
FIG. 1 generally depicts a production system having an artificial lift apparatus to draw fluid from a well to the surface in accordance with one embodiment of the present disclosure.

Turning now to the present figures, a system 10 is illustrated in FIG. 1 in accordance with one embodiment. Notably, the system 10 is a production system that facilitates extraction of a resource, such as oil, from a reservoir 12 through a well 14. Wellhead equipment 16 is installed on the well (e.g., attached to the top of casing and tubing strings in the well). In one embodiment, the wellhead equipment 16 includes a casing head and a tubing head. But the components of the wellhead equipment 16 can differ between applications, and such equipment could include various casing heads, tubing heads, stuffing boxes, pumping tees, and pressure gauges, to name only a few possibilities.

Figure 2:
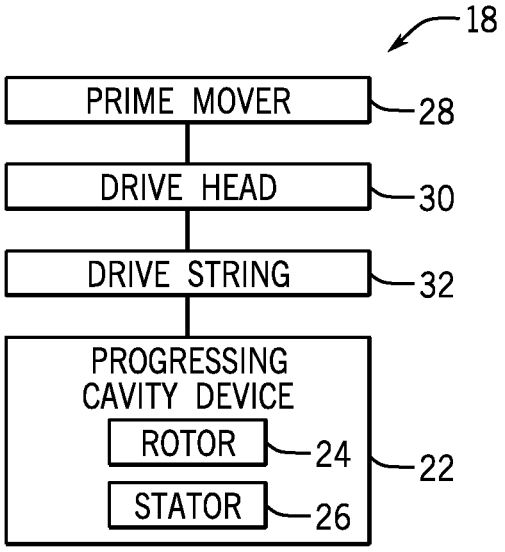
FIG. 2 is a block diagram of various components of the artificial lift apparatus of FIG. 1, including a progressing cavity device, in accordance with one embodiment.

The system 10 also includes an artificial lift apparatus 18. In one embodiment generally depicted in FIG. 2, the artificial lift apparatus 18 includes a progressing cavity device 22 that operates as a downhole pump in the well 14. The progressing cavity device 22 includes a rotor 24 and a stator 26. In the presently depicted embodiment, in which the progressing cavity device 22 operates as a pump of the artificial lift apparatus 18, the rotor 24 rotates with respect to the stator 26 to pump fluid through the device 22 and from the reservoir 12 to the surface through the well 14.

The apparatus 18 also includes a prime mover 28 that cooperates with a drive head 30 to rotate a drive string 32 that extends downward through the well 14 to the progressing cavity device 22. The prime mover 28 and the drive head 30 can be provided at the surface—mounted to the wellhead equipment 16, for example. The prime mover 28 can be provided in any suitable form, such as a diesel engine, a gas engine, or an electric motor. The drive head 30 can include a gear box to reduce rotational output from the prime mover 28 so that the drive string 32 (e.g., a sucker-rod string) rotates at a speed appropriate for operating the progressing cavity device 22.

Figure 3:
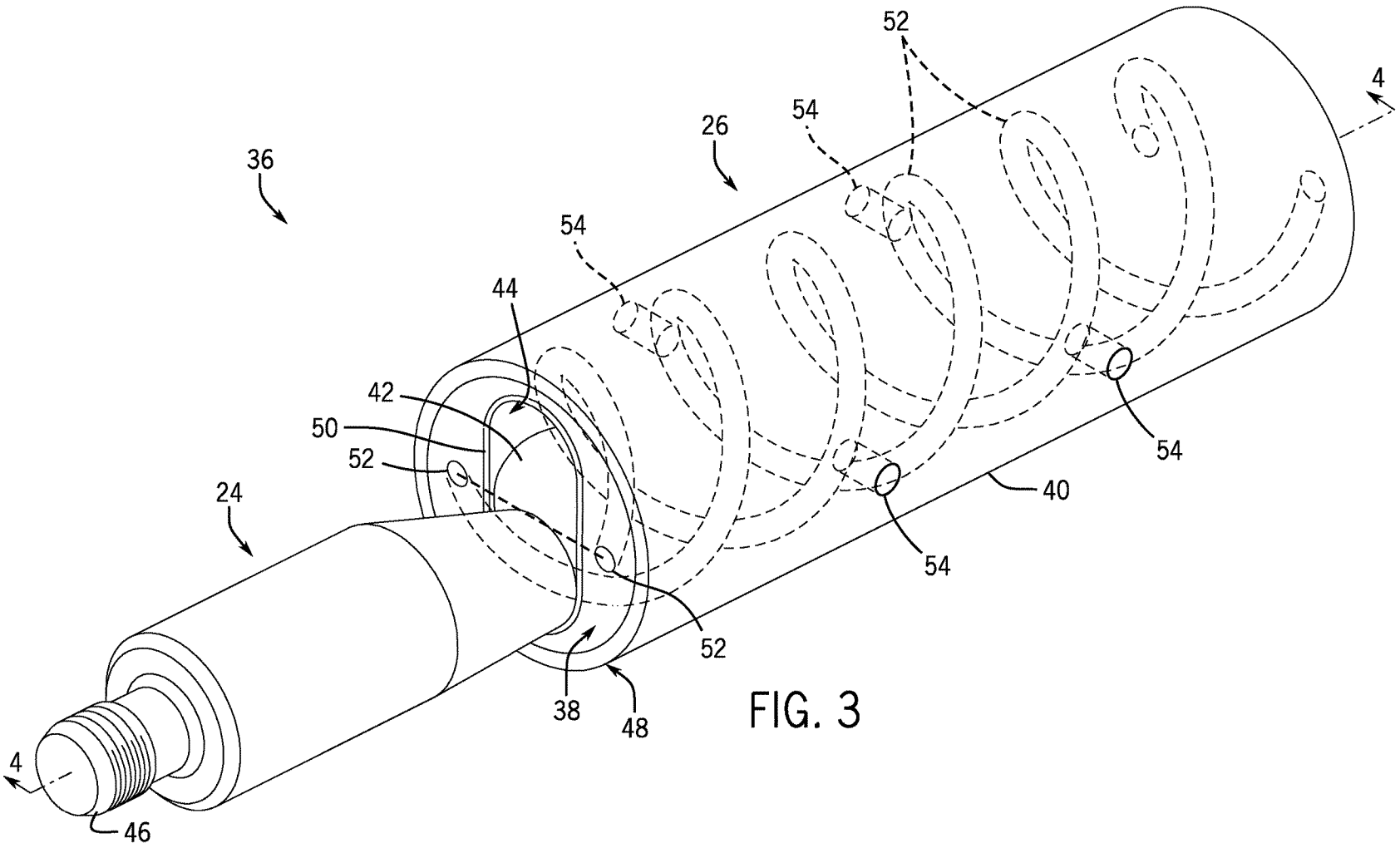
FIG. 3 is a perspective view of a progressing cavity device provided in the form of a progressing cavity pump having a stator with gas breakout ports in accordance with one embodiment.
Figure 4:
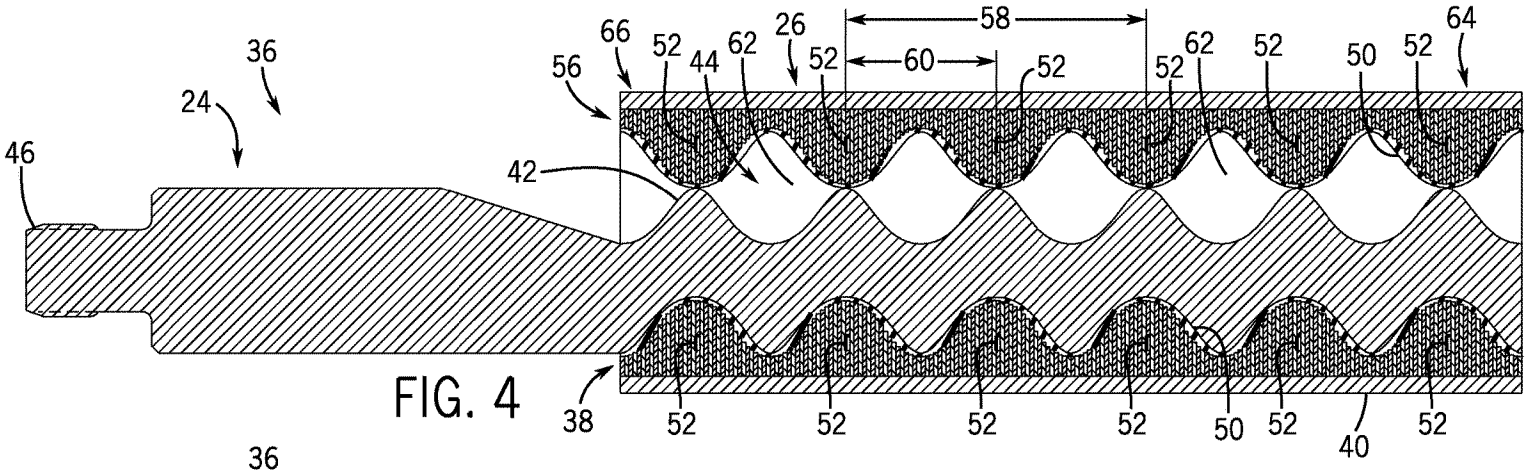
FIGS. 4 and 5 are cross-sections generally depicting certain features of the progressing cavity pump of FIG. 3, including a series of discs that form a stator core of the pump.
Figure 5:
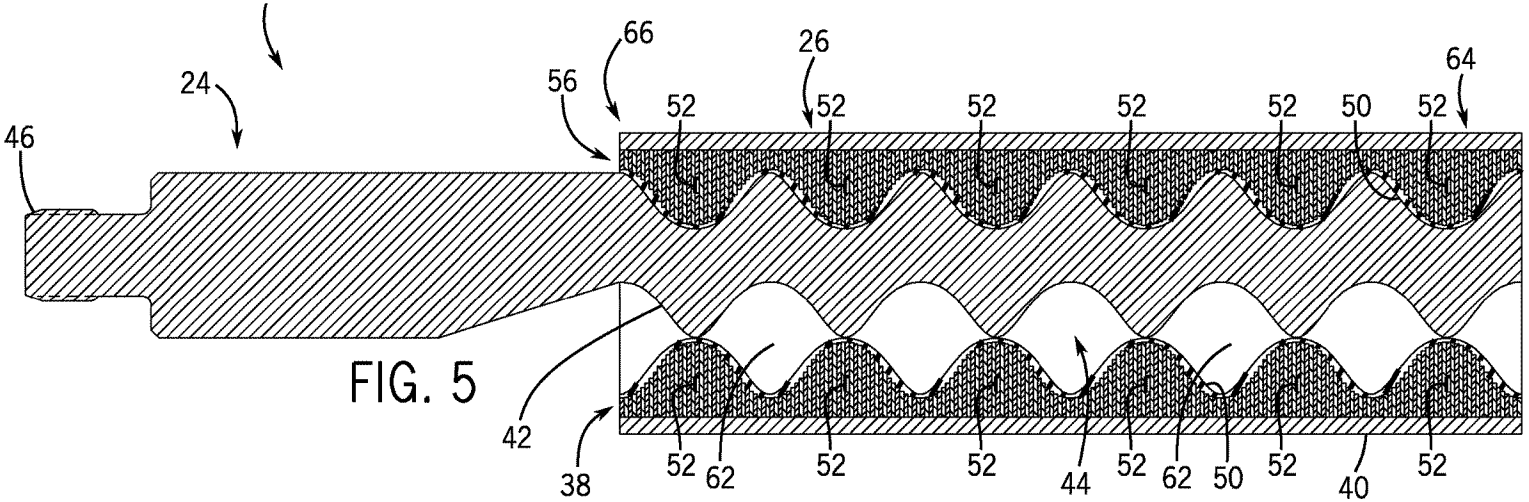

One example of a progressing cavity device 22 is depicted in FIGS. 3-5 in the form of a progressing cavity pump 36. The stator 26 of the pump 36 includes a stator core 38 installed within a housing 40. In at least some embodiments, the stator core 38 and the housing 40 are both formed from metal. In the presently illustrated embodiment, the stator core 38 includes a series of plates (here depicted as discs) with elongated apertures, and the housing 40 is a hollow tube that receives the plates of the stator core 38. It will also be appreciated that other arrangements could instead be used. For example, the plates could be provided in some other (non-disc) shape, the housing 40 could be provided in a different shape, or the housing 40 could be omitted from the pump 36.

The rotor 24 includes a helical profile 42 (which may also be considered to include a spiraled tooth for engaging the stator 26) positioned within a rotor cavity or conduit 44 of the stator core 38. As described in greater detail below, the rotor conduit 44 is formed by elongated apertures in the plates of the stator core 38. Individual plates of the stator core 38 are rotationally offset with one another such that the apertures of the series of plates form a helically wound rotor conduit 44 for receiving a contoured portion of the rotor 24 having the helical profile 42.

The rotor 24 and the stator 26 may be connected to other equipment in any suitable manner. For instance, the rotor 24 depicted in FIG. 3 includes a threaded connection end 46 that facilitates coupling to an input shaft (e.g., the drive string 32 in a wellbore environment). The stator 26 could be attached to a production tubing string in the well 12 in some embodiments, such as by threading an end 48 of the stator 26 and connecting it to the production tubing string with a threaded collar or sub. But the stator 26 could be secured within the well 12 in other ways. And while the pump 36 is presently described in connection with downhole applications, it will be appreciated that the pump 36 could be used outside of a wellbore.

Figure 7:
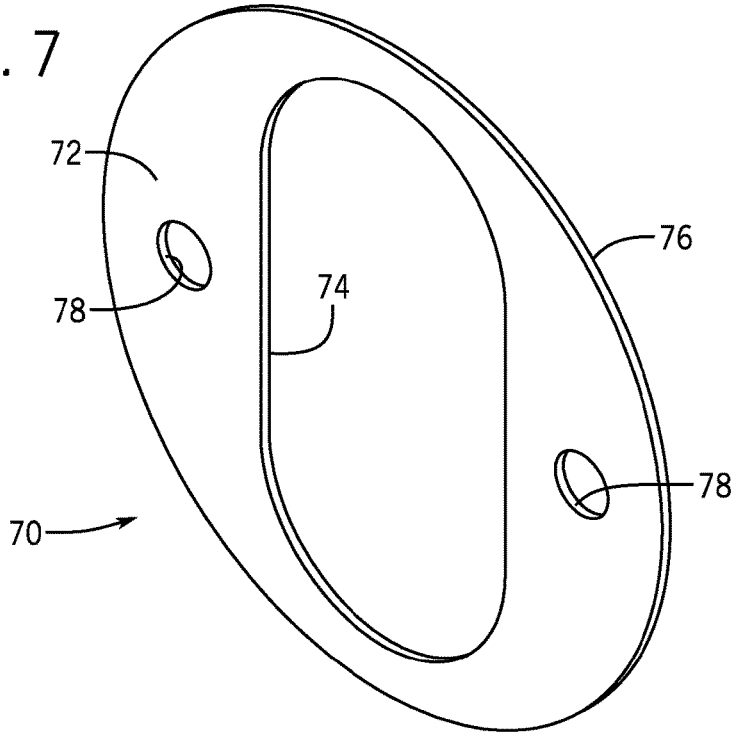
FIGS. 7 and 8 depict an individual disc representative of the discs of the stator core depicted in FIGS. 3-5.
Figure 8:
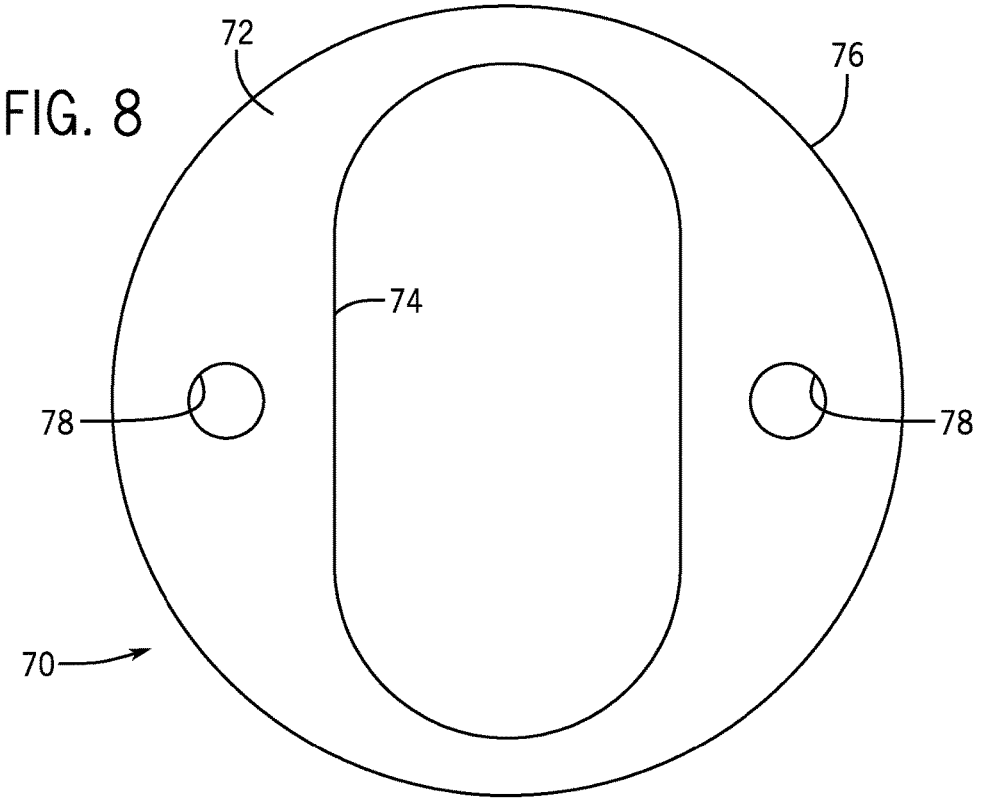

Operation of the pump 36 may be better understood with reference to the cross-sections depicted in FIGS. 4 and 5. As shown in these figures, the stator core 38 includes a series of discs denoted with reference numeral 56. One example of such discs is generally depicted in FIGS. 7 and 8, although the discs or other plates of the stator core 38 could take different forms in other embodiments. The discs of the series 56 are rotationally offset with respect to one another such that the ends of the elongated apertures in the discs generally define two teeth or ridges (corresponding to opposite sides of the discs about their apertures) that wind through the stator core 38 in the form of a double helix. In the presently depicted embodiment, in which a single-toothed rotor 24 cooperates with a double-toothed stator 26, the pump 36 is a single-lobe pump. But the pump 36 could be provided as a multiple-lobe pump in other embodiments.

With reference to FIG. 4, the winding rotor conduit 44 of the stator 26 includes a stator pitch 58. In the present single-lobe arrangement, the helical profile 42 of the rotor 24 includes a rotor pitch 60 that is half that of the stator pitch 58. The stator 26 is depicted here as having a length three times that of the stator pitch 58, but could be of any desired length in other embodiments.

The rotor 24 can be rotated (e.g., by the drive string 32 attached to a connection end 46 of the rotor 24) within the conduit 44 to draw fluids through the stator 26. In operation, the rotor 24 seals against the inner surface of the stator 26 (more specifically, against a coating 50 as described below) to retain fluid within individual chambers or cavities 62 of the rotor conduit 44 between the rotor 24 and the stator 26. These fluid cavities 62, upon rotation of the rotor 24, progress in winding fashion about the rotor 24 and through the stator 26 from an intake end 64 to a discharge end 66 such that fluid is drawn through the stator 26 at a rate that varies based on the rotational speed of the rotor 24 about its axis. In another embodiment, the pump 36 can be arranged such that the end 66 is the intake end and the end 64 is the discharge end. Although described herein as being able to convert rotation of the rotor 24 into fluid flow, the pump 36 could instead be arranged to perform the reverse—that is, to convert fluid flow into rotation of a component. In such a variation, the pump 36 could serve as a downhole mud motor or some other device.

FIG. 5 generally depicts the rotor 24 having been turned by 180 degrees from its position in FIG. 4. At both of these depicted positions of the rotor 24 within the stator 26, the rotational axis of the rotor 24 differs from the central axis of the stator. As the rotor 24 is driven about its own axis (e.g., by drive string 32), it also rotates eccentrically with respect to the axis of the stator 26 due to engagement of the helical profile 42 with the inner surface of the stator 26. It is also noted that while the pump 36 is configured as a right-handed device (with a right-handed helical profile of the rotor 24), other progressing cavity devices 22 could instead be configured as left-handed devices with rotors 24 having left-handed helical profiles that wind in a direction opposite that of the rotor 24 of pump 36.

As generally depicted in FIGS. 3-5, the stator 26 includes a coating 50 provided on the edges of the plate apertures that form the rotor conduit 44. The coating 50, which may be provided as a layer of elastomer or other suitable material, can be a deformable layer that facilitates sealing engagement between the rotor 24 and the stator 26 to reduce slip during operation of the pump 36. The coating 50 can also serve as a barrier layer between the interior of the rotor conduit 44 on the one hand and interstitial spaces between adjoining plates of the stator core 38 on the other. This allows the coating 50 to inhibit the flow of fluid from inside the conduit 44 (e.g., from progressing fluid cavities 62) to the interstices between the plates of the stator.

In some instances, however, pressurized gas inside the conduit 44 could penetrate through the coating 50, allowing the gas to collect behind the coating 50 and between the plates of the stator core 38. And if pressure were to then decrease in the conduit 44, a pressure differential between gas behind the coating 50 and the fluid in the conduit 44 could cause blistering or other damage to the coating 50. Consequently, the stator 26 includes gas breakout ports or conduits 52 that facilitate the egress of pressurized gas from the stator core 38.

The gas breakout ports 52 can be formed in the stator core 38 in any suitable manner. For instance, in the depicted embodiment, the stator 26 includes two gas breakout ports 52 that wind helically about the rotor conduit 44 through the stator core 38 from one end of its discs to the other. These gas breakout ports 52 are spaced apart from the rotor conduit 44 and are in fluid communication with the interstitial spaces between the discs of the stator core 38. This allows gas that penetrates through the coating 50 (as well as any other gas present in the stator core 38 behind the coating 50) to flow to the gas breakout ports 52 via the interstitial spaces between the discs and then exit the stator 26, thereby enabling pressure balancing of the stator core 38 with the environment outside of the stator 26.

Although the stator 26 is shown as having two gas breakout ports 52 in FIG. 3, other progressing cavity stators could have fewer or more gas breakout ports in accordance with the present technique. Further, in one embodiment the gas breakout ports 52 are formed by apertures in the discs of the stator core 38 that are offset from one another. But in other embodiments the gas breakout ports 52 could be formed in other ways, such as being machined in the assembled stator core 38.

Figure 6:
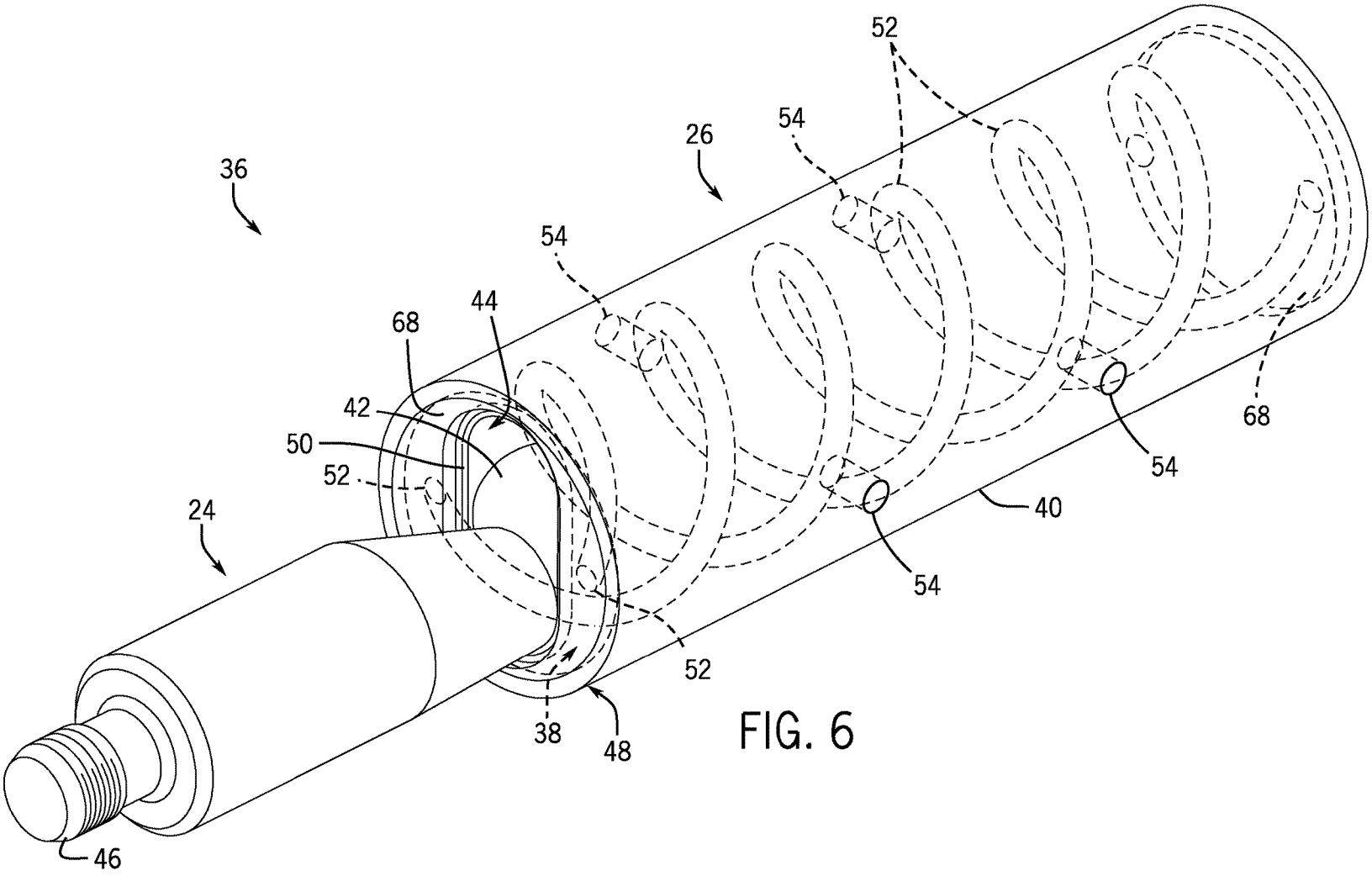
FIG. 6 is a perspective view of a progressing cavity pump similar to that of FIGS. 3-5, but in which the stator core is disposed in a housing between a pair of end plates in accordance with one embodiment.

The depicted stator 26 also includes additional ports or conduits 54 that connect the gas breakout ports 52 to the exterior environment. Gas within one of the gas breakout ports 52 can escape the stator 26 by traveling to the end of the gas breakout port 52 or by passing through one of the additional conduits 54. To prevent pumped fluid exiting a discharge end of the pump 36 from returning to the intake end through the gas breakout ports 52 in the stator 26, the gas breakout ports 52 can be plugged or capped in any suitable manner. For example, in some embodiments the discs of the stator core 38 are disposed in the housing 40 between end plates 68, as generally depicted in FIG. 6. The additional conduits 54 allow gas within the gas breakout ports 52 to escape from the stator core 38 even when the end plates 68 block the ends of the gas breakout ports 52. The conduits 54 can also be formed in any suitable number and way, such as by boring holes through the housing 40 and into the stator core 38 to connect with the gas breakout ports 52.

One example of an individual disc 70 of the stator core 38 is illustrated in FIGS. 7 and 8. As shown in these figures, each individual disc 70 includes a body 72 having a circumferential edge 76 and an elongated aperture 74. In the presently depicted embodiment, the aperture 74 is provided as a central aperture in the shape of an oval through the disc 70. The discs 70 also include additional apertures 78. The apertures 74 and 78 can be cut from the body 72 via laser cutting in some embodiments, or can be formed through any other suitable manufacturing techniques (e.g., stamping).

Figure 9:
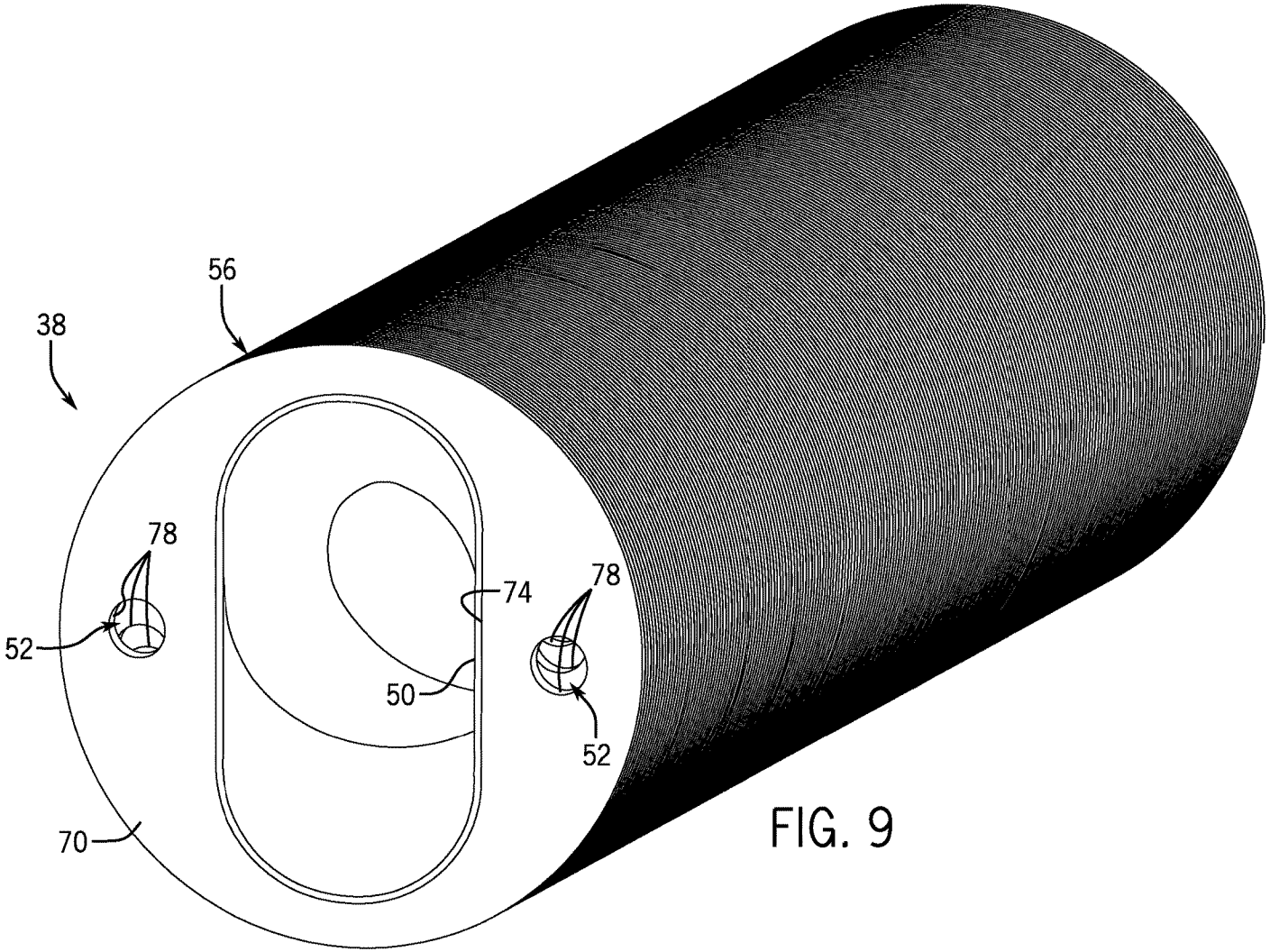
FIG. 9 is a perspective view of the stator core of FIGS. 3-5 before it is installed in a housing in accordance with one embodiment.
Figure 10:
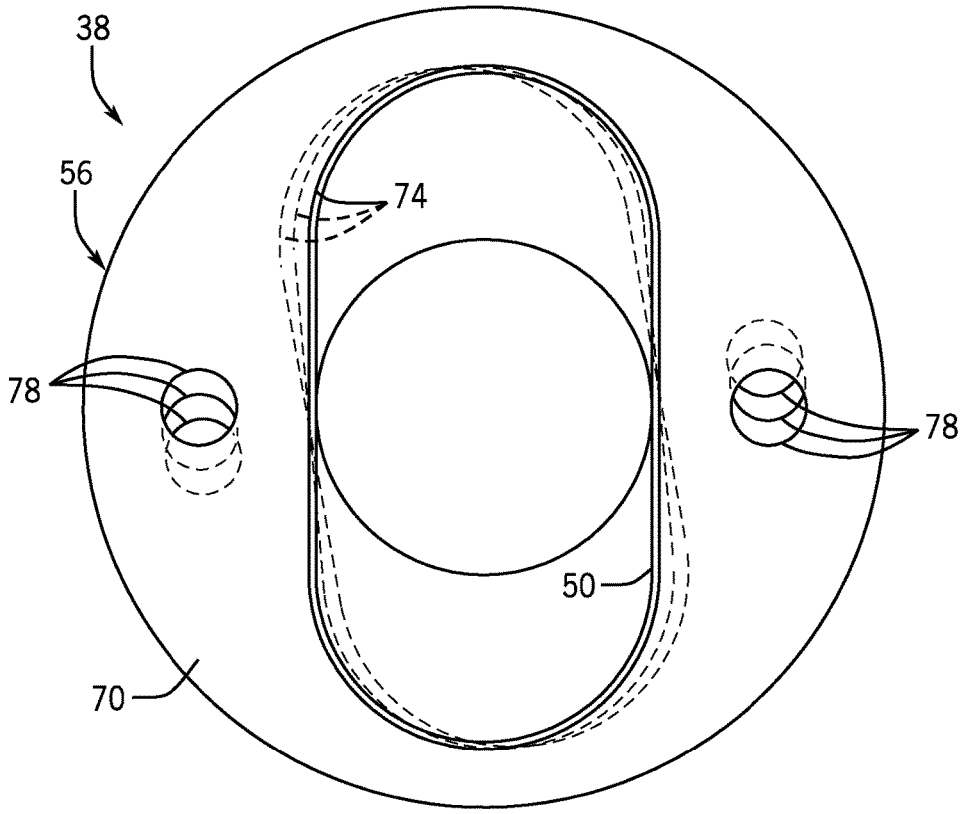
FIG. 10 is a front elevational view of the stator core of FIG. 9 and generally depicts how disc apertures overlap to form the gas breakout ports in accordance with one embodiment.

By way of further example, the stator core 38 is depicted in greater detail in the perspective and front elevational views of FIGS. 9 and 10. As shown here in FIG. 9, as well as in FIGS. 4 and 5, the stator core 38 has a length that is three times the stator pitch 58, although the stator core 38 could have any desired length as noted above. With a stator length equal to three times the stator pitch 58, each disc 70 of the stator core 38 is rotationally offset with respect to its neighbor to cause the rotor conduit 44 to wind through three full turns (one turn per stator pitch length). This rotational offset also causes the apertures 78 of adjacent discs 70 to overlap one another and form the gas breakout conduits 52, as generally depicted in FIG. 10. The apertures 74 and 78 of the foremost disc 70 of the stator core 38 are fully shown in FIG. 10, with the apertures 74 and 78 of the next two discs 70 in the stator core 38 partially drawn in phantom (where obscured by the foremost disc 70 and the coating 50) to generally illustrate the rotational offset of these neighboring discs.

In one embodiment the stator core 38 includes seventy-two individual discs 70 per stator pitch length, with the discs 70 rotationally staggered at five-degree intervals and each having a thickness of one-sixteenth of an inch (about 1.6 mm). But the dimensions of the discs or plates, as well as the number of such discs or plates per stator pitch length (along with the amount of rotational offset), could differ in other embodiments.

It will be appreciated that the stator core 38 can be installed in the bore of the housing 40 and retained in any suitable fashion. For example, the series 56 of discs 70 could be bonded to the housing 40, retained by an interference fit, or retained by end caps (e.g., end plates 68) coupled to the housing 40. Additionally, the discs can also be joined to one another prior to installation in the housing 40, such as through welding or bonding. After the stator core 38 is installed in the housing, the conduits 54 depicted in FIG. 3 can be formed, such as by boring holes through the housing and into the stator core 38 as described above.

The coating 50 can be formed on the edges of the apertures 74 in various ways. For example, the coating 50 can be applied via injection molding (e.g., by inserting a mold inside the cavity 44 and feeding the material of the coating 50 to fill the space between the mold and the edges of the apertures 74). The rotor 24 can then be inserted into the assembled stator 26 as generally depicted in FIG. 3.

While the aspects of the present disclosure may be susceptible to various modifications and alternative forms, specific embodiments have been shown by way of example in the drawings and have been described in detail herein. But it should be understood that the invention is not intended to be limited to the particular forms disclosed. The presently disclosed techniques may be applied to other progressing cavity devices, such as to mud motors or other devices that use fluid flow to drive rotation of a component rather than driving rotation of the rotor to cause fluid flow. The invention is to cover all modifications, equivalents, and alternatives falling within the spirit and scope of the invention as defined by the following appended claims.

The invention claimed is:

1. A system comprising:

a stator of a progressing cavity device, the stator including:

a plurality of metal plates with apertures that are rotationally offset to form a winding rotor conduit for receiving a rotor of the progressing cavity device;

a layer of elastomer provided on edges of the apertures of the metal plates in the winding rotor conduit; and a gas breakout port through at least some of the metal plates and isolated from the winding rotor conduit by the layer of elastomer, wherein the gas breakout port enables gas between the metal plates to exit the stator.

2. The system of claim 1, wherein the gas breakout port is formed of additional apertures in the metal plates, with the additional apertures being rotationally offset to form a helical gas breakout port through the stator.

3. The system of claim 2, wherein the gas breakout port includes multiple helical gas breakout ports through the stator.

4. The system of claim 1, comprising a housing of the progressive cavity device, wherein the metal plates are positioned within the housing.

5. The system of claim 4, comprising a conduit through the housing and in fluid communication with the gas breakout port to facilitate egress of gas in the gas breakout port from the stator.

6. The system of claim 5, comprising end plates provided at opposite ends of the metal plates within the housing.

7. The system of claim 1, wherein the metal plates comprise metal discs.

8. The system of claim 1, wherein the progressing cavity device is a single-lobe device.

9. The system of claim 1, wherein the progressing cavity device is a progressing cavity pump.

10. The system of claim 1, comprising an oilfield apparatus including the progressing cavity device.

11. A system comprising:

a series of plates assembled to form a stator of a progressing cavity device, the stator including first and second conduits through the series of plates, the first conduit having a coating that inhibits fluid flow from inside the first conduit to the second conduit through interstices between the plates, wherein the second conduit is in fluid communication with the interstices and the stator includes a third conduit extending laterally from the second conduit to an exterior of the stator so as to allow gas in the coating to escape from the stator via the second conduit and the third conduit.

12. The system of claim 11, wherein the second conduit extends from one end of the series of plates to an opposite end of the series of plates.

13. The system of claim 11, wherein the second conduit winds helically through the series of plates.

14. The system of claim 11, comprising a rotor disposed in the first conduit.

15. The system of claim 11, wherein the plates comprise metal plates.

16. The system of claim 11, wherein the progressing cavity device is a progressing cavity pump.

17. A method comprising:

providing plates each having a central aperture;

forming a stator core of a progressing cavity device using the plates, wherein forming the stator core includes providing a rotor conduit formed by the central apertures of the plates and providing a gas breakout conduit spaced apart from the rotor conduit to facilitate escape of gas between the plates to outside the stator core during operation of the progressing cavity device;

installing the stator core in a housing; and boring a hole through the housing to the gas breakout conduit.

18. The method of claim 17, comprising forming a barrier layer on the plates inside the rotor conduit.

19. The method of claim 17, wherein each of the plates includes an additional aperture separate from the central aperture and providing the gas breakout conduit includes assembling the plates such that the gas breakout conduit is formed by the additional apertures.

* * * * *